US010352647B1

(12) United States Patent
Wei

(10) Patent No.: US 10,352,647 B1
(45) Date of Patent: Jul. 16, 2019

(54) TOY GUN AND GAS BOTTLE INSTALLING STRUCTURE THEREOF

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 15/949,645

(22) Filed: Apr. 10, 2018

(51) Int. Cl.
*F41B 11/62* (2013.01)
*F41B 11/723* (2013.01)
*F41B 11/89* (2013.01)

(52) U.S. Cl.
CPC ..... *F41B 11/62* (2013.01); *F41B 11/723* (2013.01); *F41B 11/89* (2013.01)

(58) Field of Classification Search
CPC ..... F41B 11/62; F41B 11/723; F41B 11/89; F41B 11/60; F41B 11/721
USPC ..... 124/71–77
See application file for complete search history.

(56) References Cited

U.S. PATENT DOCUMENTS 5,404,863 A * 4/1995 Poor ..... F41B 11/62 124/56
5,884,615 A * 3/1999 Casas Salva ..... F41B 11/51 124/31
RE39,805 E * 9/2007 Maeda ..... 124/73
7,757,682 B2 * 7/2010 Kaminker ..... F41B 11/62 124/56
8,602,784 B2 * 12/2013 Dvorak ..... F41A 33/02 434/11
2003/0047174 A1 * 3/2003 Tiberius ..... F41B 11/51 124/74
2004/0200466 A1 * 10/2004 Salva ..... F41B 11/56 124/74
2006/0162711 A1 * 7/2006 Maeda ..... F41B 11/723 124/73
2006/0201491 A1 * 9/2006 Wei ..... F41B 11/56 124/74
2008/0060630 A1 * 3/2008 Halmone ..... F41B 11/55 124/73
2008/0168972 A1 * 7/2008 Wei ..... F41B 11/56 124/69
2010/0031944 A1 * 2/2010 Maeda ..... F41B 11/723 124/74
2010/0263652 A1 * 10/2010 Maeda ..... F41B 11/51 124/73
2011/0041826 A1 * 2/2011 Liao ..... F41B 11/62 124/71
2011/0131882 A1 * 6/2011 Wei ..... B25C 1/08 49/142

(Continued)

*Primary Examiner* — John Cooper
(74) *Attorney, Agent, or Firm* — Chung-Ming Shih; HDLS IPR Services

(57) ABSTRACT

A gas bottle installing structure (1) for use in toy gun includes a gas bottle cylinder (10), including a shell body (11), an accommodation space (100) capable of accommodating a gas bottle (2), and a base (12) formed with a penetration hole (120). The shell body (11) is formed with a communication hole (110) at an opposite side relative to the penetration hole (120); a piercing pin seat (20), disposed at one side of the communication hole (110); and a screw seat set (30), including a nut seat (31) penetrating the penetration hole (120), a screw seat (32) combined at an outer end of the nut seat (31), and an elastic member (33) elastically clamped between the base (12) and the screw seat (32). Accordingly, a structure enabling the gas bottle to be easily installed and allowing the gas bottle to be rapidly pierced is provided.

18 Claims, 6 Drawing Sheets

(56) References Cited

U.S. PATENT DOCUMENTS

| | | | | |
|---|---|---|---|---|
| 2012/0129136 | A1* | 5/2012 | Dvorak | F41A 33/02<br>434/18 |
| 2013/0192577 | A1* | 8/2013 | Maeda | F41B 11/62<br>124/74 |
| 2013/0263840 | A1* | 10/2013 | Maeda | F41B 11/721<br>124/76 |
| 2014/0290637 | A1* | 10/2014 | Maeda | F41B 11/62<br>124/74 |
| 2014/0338650 | A1* | 11/2014 | Maeda | F41B 11/62<br>124/74 |
| 2015/0027427 | A1* | 1/2015 | Maeda | F41B 11/52<br>124/73 |
| 2015/0300771 | A1* | 10/2015 | Tseng | F41B 11/62<br>124/74 |
| 2017/0153082 | A1* | 6/2017 | Maeda | F41B 11/62 |

* cited by examiner

TOY GUN AND GAS BOTTLE INSTALLING STRUCTURE THEREOF

BACKGROUND OF THE INVENTION

Field of the Invention

The present invention relates to a toy gun, especially to a toy gun and a gas bottle installing structure thereof.

Description of Related Art

A conventional toy gun utilizing a gas bottle as a power source for striking bullets is equipped with a pressurized steel bottle to generate a pressure for providing a power required for the purpose of striking a bullet. In addition, the pressurized steel bottle in a gun body (or a magazine) is disposed in the interior of the gun body by utilizing a screw seat so as to be screwed and fastened, so that the pressurized steel bottle can be pushed and positioned inside the gun body. On the other hand, a propelling pin is disposed inside the gun body at a location corresponding to a bottle opening of the pressurized steel bottle; after the pressurized steel bottle is pushed into the interior of the gun body, the bottle opening of the pressurized steel bottle is pierced by the propelling pin, so that the internal pressure of the pressurized steel bottle is released for providing a power to strike a plastic bullet.

However, the screw seat of the conventional toy gun is rotated for being disposed inside the gun body for the purpose of piercing the pressurized steel bottle, the above-mentioned time consuming arrangement would cause inconveniences to users, especially to those users who are into a survival game in which every second is crucial for winning or losing.

Accordingly, the applicant of the present invention has devoted himself for improving the mentioned disadvantages.

SUMMARY OF THE INVENTION

The present invention is to provide a toy gun and a gas bottle installing structure thereof, in which a piercing pin seat is disposed at one side of a communication hole of a gas bottle cylinder, and a screw seat set is disposed on a base of the gas bottle cylinder, so that a structure enabling a gas bottle to be easily installed and allowing the gas bottle to be rapidly pierced is provided.

Accordingly, a gas bottle installing structure for use in toy gun comprising a gas bottle cylinder, a piercing pin seat and a screw seat set is provided by the present invention. The gas bottle cylinder includes a shell body, an accommodation space capable of accommodating a gas bottle, and a base, wherein the base is formed with a penetration hole, and the shell body is formed with a communication hole at an opposite side relative to the penetration hole; the piercing pin seat is disposed at one side of the communication hole; the screw seat set includes a nut seat penetrating the penetration hole, a screw seat combined at an outer end of the nut seat, and an elastic member elastically clamped between the base and the screw seat.

Accordingly, a toy gun comprising a gun body and a gas bottle installing structure is provided by the present invention, wherein the gas bottle installing structure is combined with the gun body for assembling the toy gun.

In comparison with related art, the present invention has advantages as follows. According to the toy gun and the gas bottle installing structure thereof provided by the present invention, the base of the gas bottle cylinder is formed with the penetration hole, the communication hole is formed at the opposite side relative to the penetration hole, the piercing pin seat is disposed at one side of the communication hole and the screw seat set is disposed in the penetration hole; as such, via rotating a gas bottle propelling screw, the gas bottle can be propelled towards the direction of the piercing pin seat but yet to be pierced; then, the screw seat set is pushed for elastically pressing the gas bottle and a tip end of the piercing pin seat can be served to pierce the gas bottle, so that a structure enabling the gas bottle to be easily installed and allowing the gas bottle to be rapidly pierced is assembled, and the present invention is provided with advantages of more convenient and more practical in operation.

DETAILED DESCRIPTION OF THE INVENTION

A preferred embodiment of the present invention will be described with reference to the drawings.

Figure 1:
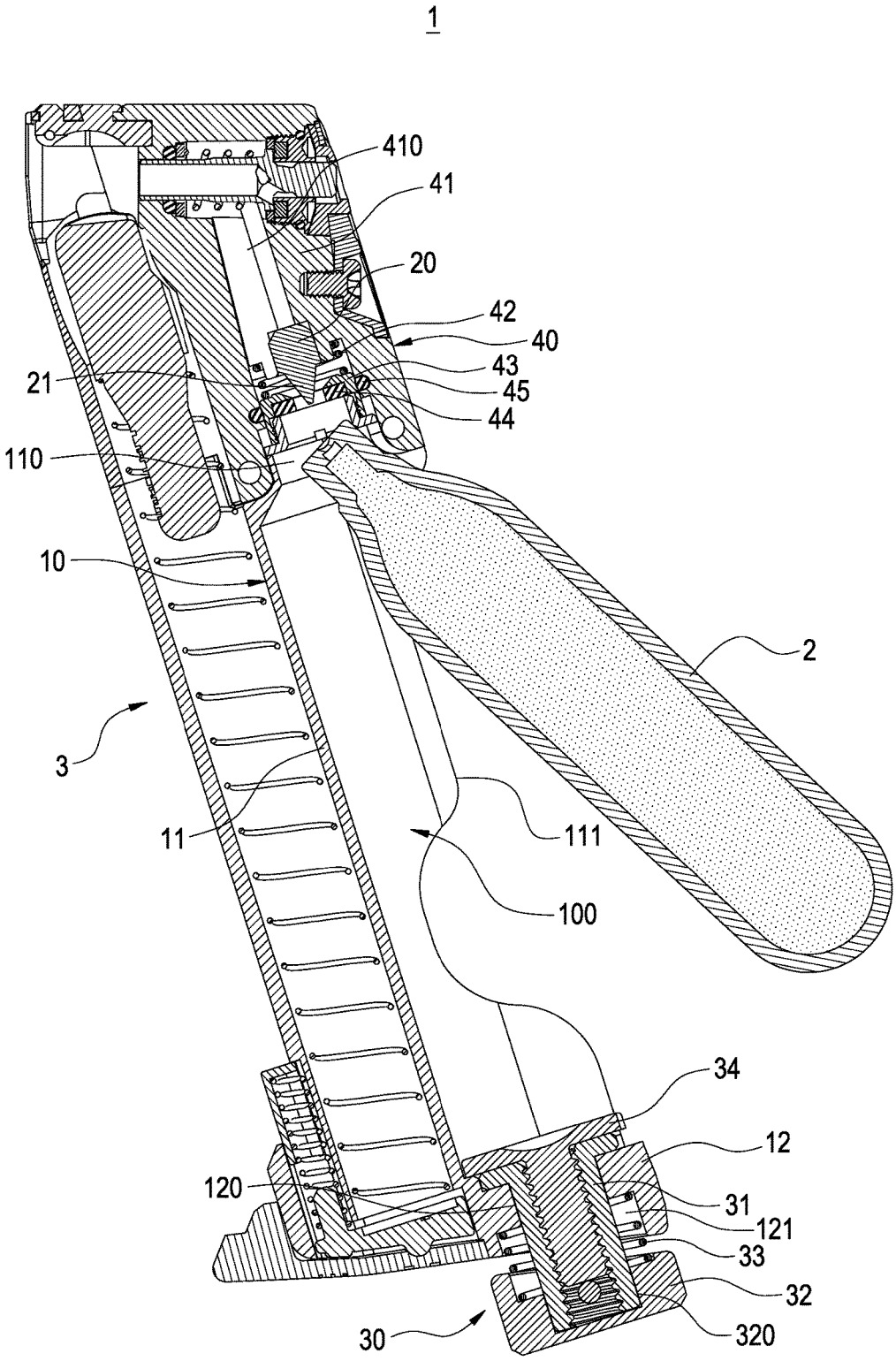
FIG. 1 is a schematic view showing a gas bottle installing status of a gas bottle installing structure for use in toy gun according to the present invention.

Please refer to FIG. 1, which is a cross sectional view showing a gas bottle installing structure for use in toy gun according to the present invention. The present invention provides a gas bottle installing structure 1 for use in toy gun, which is used for allowing a gas bottle 2 to be installed therein and comprises a gas bottle cylinder 10, a piercing pin seat 20 and a screw seat set 30. The piercing pin seat 20 and the screw seat set 30 are disposed in the gas bottle cylinder 10. The gas bottle 20 is disposed in the gas bottle cylinder 10 and pushed by the screw seat set 30, so that the piercing pin seat 20 can be served to pierce the gas bottle 20 for providing a striking force to a toy gun. More details for disclosing the gas bottle installing structure 1 are provided as follows.

The gas bottle cylinder 10 includes a shell body 11, an accommodation space 100 for accommodating the gas bottle 2, and a base 12 disposed at one side of the accommodation space 100. The base 12 is formed with a penetration hole 120, and the shell body 11 is formed with a communication hole 110 at an opposite side relative to the penetration hole 120.

Preferably, the shell body 11 is extended with an opening 111 at a direction parallel to the gas bottle 2, and the gas bottle 2 is obliquely introduced for being accommodated in the accommodation space 100. Moreover, according to this embodiment, the gas bottle cylinder 10 is disposed in a magazine 3; in an actual practice, the gas bottle cylinder 10 can also be directly disposed in a handgrip of a gun body, so that the arrangement of the gas bottle cylinder 10 is able to be optionally designed according to actual needs.

The piercing pin seat 20 is disposed at one side of the communication hole 110, and served to pierce the gas bottle 2 located in the accommodation space 100.

The screw seat set 30 includes a nut seat 31 penetrating the penetration hole 120, a screw seat 32 combined at an outer end of the nut seat 31, and an elastic member 33 elastically clamped between the base 12 and the screw seat 32. Substantially, the base 12 is formed with a first recess 121 on a lateral surface which faces the screw seat 32; and the screw seat 32 is formed with a second recess 320 on a lateral surface which faces the base 12. Accordingly, one end of the elastic member 33 is positioned in the first recess 121, and the other end of the elastic member 33 is positioned in the second recess 320. The screw seat 32 can be recovered to an initial position via the elastic member 33, and positioned at the outer end of the nut seat 31.

According to this embodiment, the elastic member 33 is a compression spring. Moreover, the screw seat set 30 further includes a gas bottle propelling screw 34, and the gas bottle propelling screw 34 is screwed in the nut seat 31.

According to one embodiment provided by the present invention, the gas bottle installing structure 1 further comprises a gas valve set 40 disposed at one side of the communication hole 110. The gas valve set 40 includes a gas valve seat 41 fastened on the gas bottle cylinder 10 and a spring 42 disposed in the gas valve seat 41. The gas valve seat 41 is formed with a gas passageway 410 communicated with the accommodation space 100. The gas valve seat 41 can be recovered to an initial position via the spring 42.

The piercing pin seat 20 is disposed in the gas passageway 410, and formed with a tip end 21 penetrating the spring 42. Substantially, the gas valve set 40 further includes a pad moveable seat 43 located in the communication hole 110. The spring 42 is disposed on the pad moveable seat 43. Preferably, the gas valve set 40 further includes a gas bottle nozzle pad 44 and a moveable seat O-ring 45, so that an airtight effect between the pad moveable seat 43 and the gas bottle 2 can be provided by the gas bottle nozzle pad 44. In addition, a groove 431 is formed on an inner wall surface of the pad moveable seat 43, and the gas bottle nozzle pad 44 is fastened in the groove 431.

Moreover, the moveable seat O-ring 45 is disposed between the gas valve seat 41 and the pad moveable seat 43, so that an airtight effect can be provided between the pad moveable seat 43 and the gas valve seat 41, and gas in the gas bottle 2 is allowed to pass the communication hole 100 so as to enter the gas passageway 410.

Figure 2:
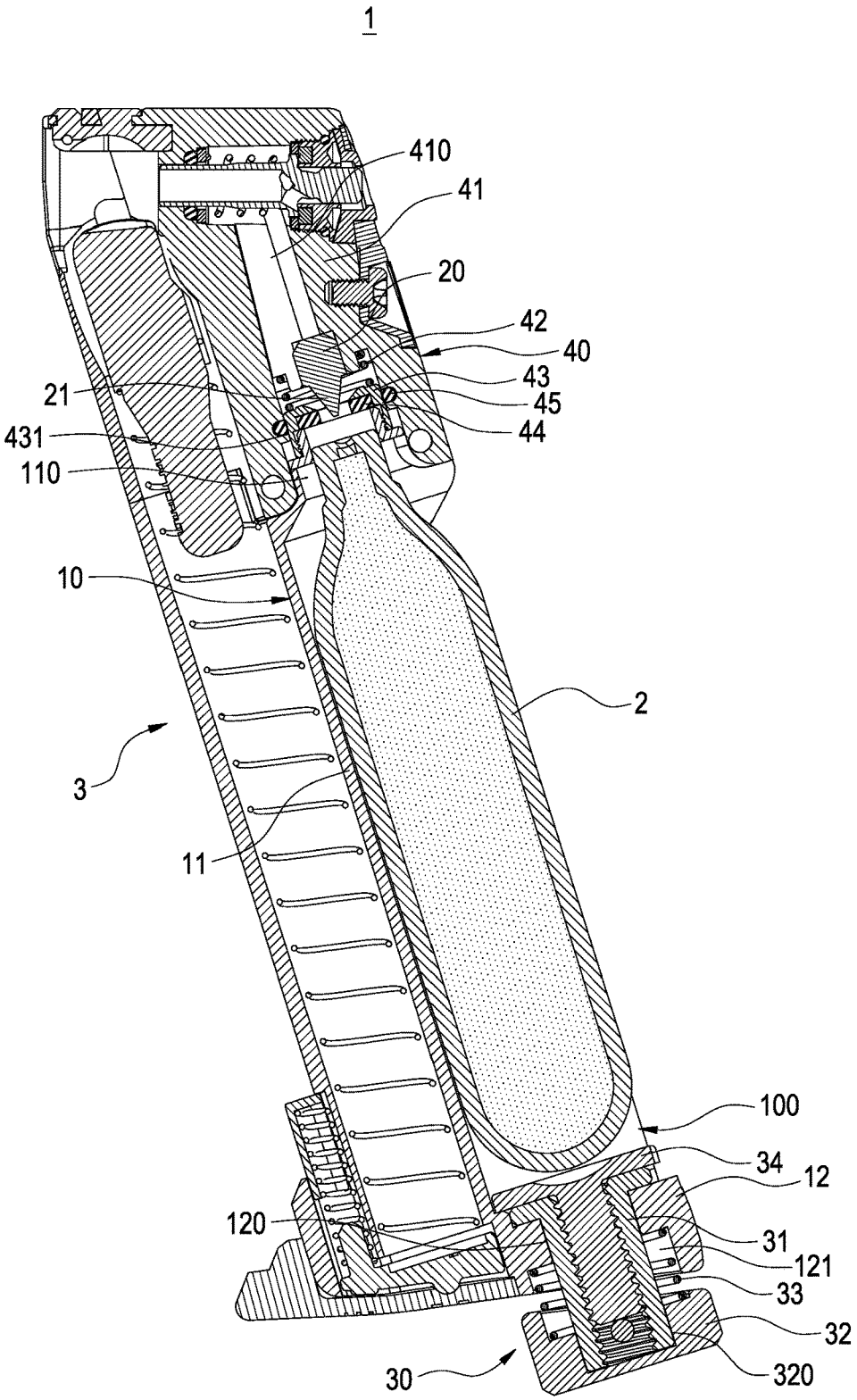
FIG. 2 is a schematic view showing a gas bottle disposing status of the gas bottle installing structure for use in toy gun according to the present invention.
Figure 3:
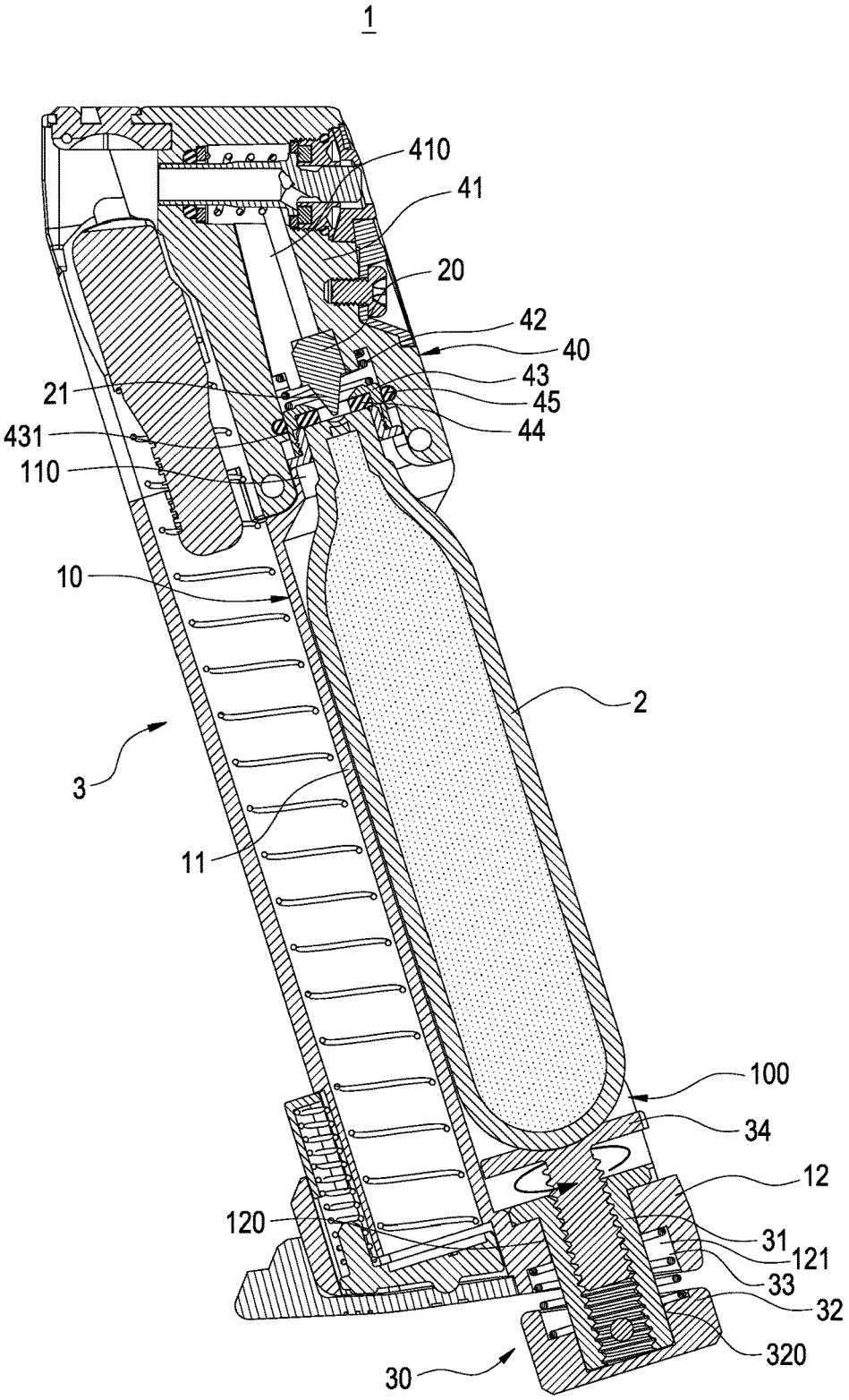
FIG. 3 is a schematic view showing an operation of piercing a gas bottle of the gas bottle installing structure for use in toy gun according to the present invention.

Please refer from FIG. 2 to FIG. 5, which are a schematic view showing a gas bottle disposing status of the gas bottle installing structure for use in toy gun and schematic views showing operations of piercing a gas bottle according to the present invention. As shown in FIG. 2, according to this embodiment, after the gas bottle 2 is inserted in the accommodation space 100 with the above-mentioned obliquely-arranging means, then as shown in FIG. 3, the gas bottle propelling screw 34 is rotated for allowing the gas bottle propelling screw 34 to be raised to propel the gas bottle 2 to be moved towards the direction of the piercing pin seat 20, so that one end of the gas bottle 20 is abutted against the tip end 21 of the piercing pin seat 20 but yet to be pierced.

Figure 4:
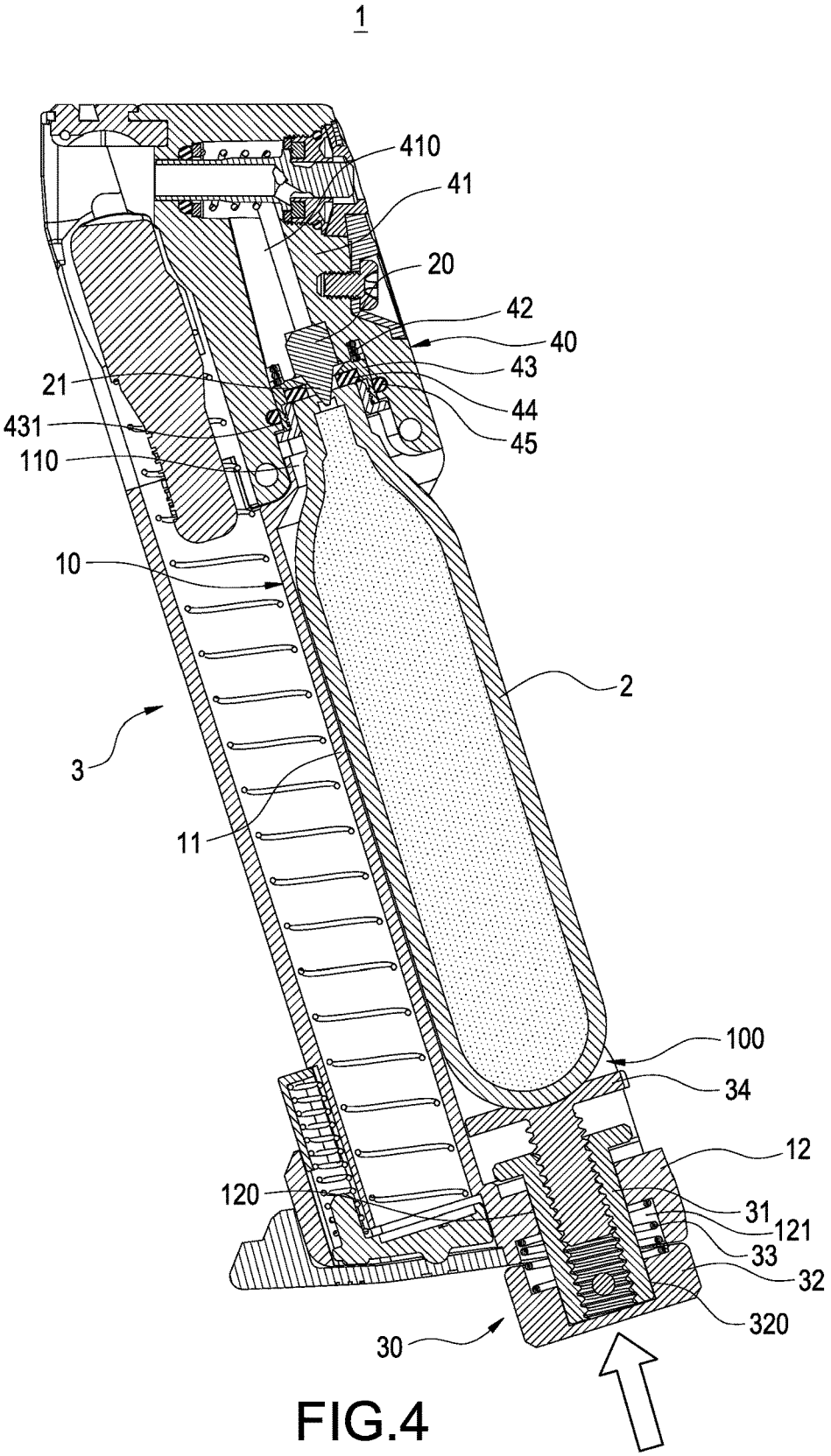
FIG. 4 is a schematic view showing another operation of piercing the gas bottle of the gas bottle installing structure for use in toy gun according to the present invention.

As shown in FIG. 4, when the toy gun of the present invention is desired to be operated, the screw seat 32 of the screw seat set 30 is pushed, so that the screw seat 32 is raised for pushing the nut seat 31 towards the gas bottle 2. At this moment, the elastic member 33 is pushed by the nut seat 32 for being elastically compressed, and the nut seat 31 is served to drive the gas bottle propelling screw 34 to further propel towards the direction of the piercing pin seat 20, so that the tip end 21 of the piercing pin seat 20 is able to pierce the gas bottle 2.

Figure 5:
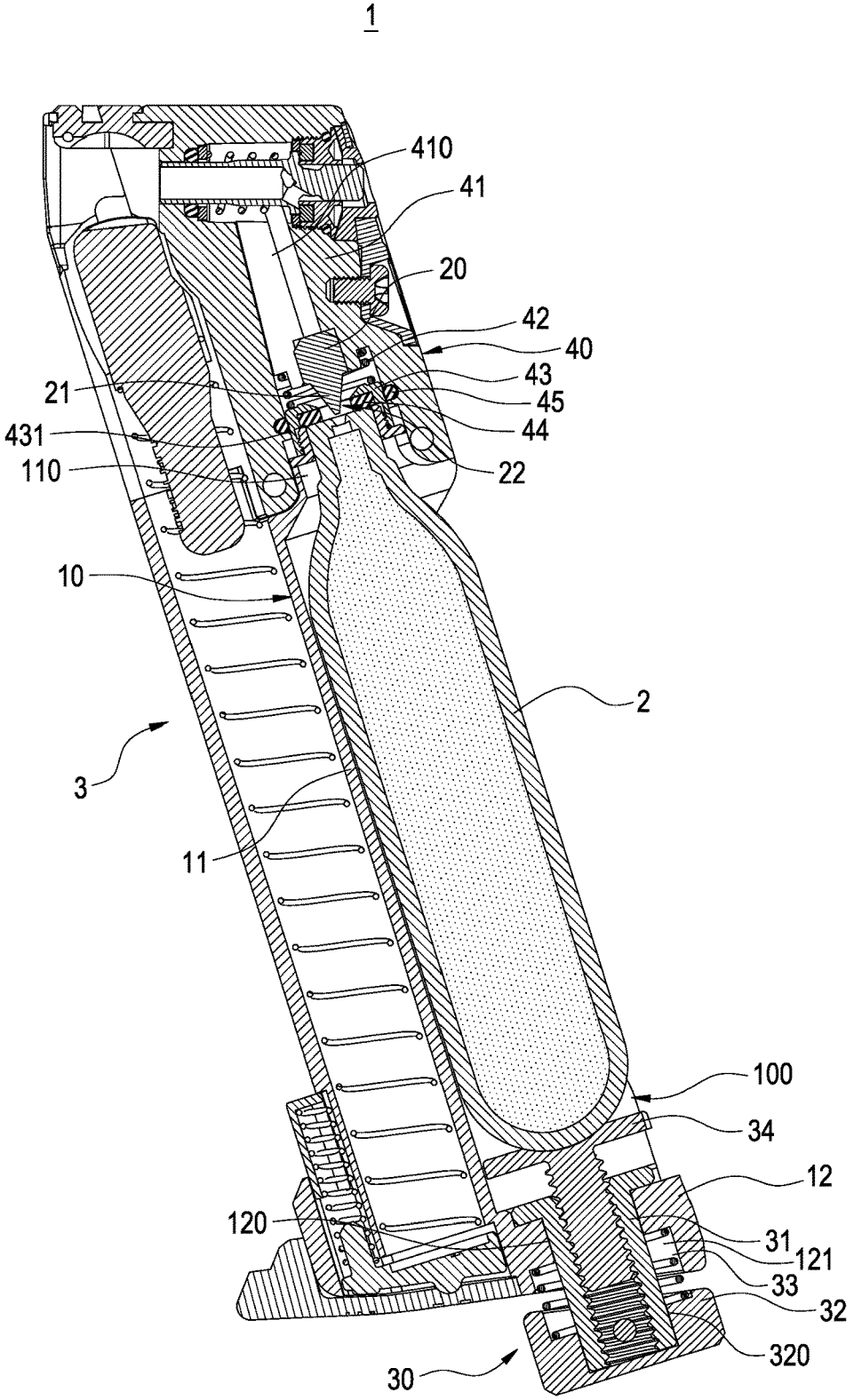
FIG. 5 is a schematic view showing one another operation of piercing the gas bottle of the gas bottle installing structure for use in toy gun according to the present invention.

As shown in FIG. 5, the screw seat 32 is no longer pushed after the gas bottle 2 is pierced, at this moment, the screw seat 32 is able to be recovered to the initial position via an elastic recovering force provided by the elastic member 33, the nut seat 31 is served to drive the gas bottle propelling screw 34 to be moved towards a direction away from the piercing pin seat 20, and the gas bottle 2 is retracted from the tip end 21 of the piercing pin seat 20 along with the gas bottle propelling screw 34. In addition, the gas bottle 2 is moved towards a direction away from the pad moveable seat 43 while the screw seat 32 being recovered to the initial position. As such, a gap 22 is formed between the gas bottle 2 and the pad moveable seat 43, at this moment, the gas inside the gas bottle 2 is allowed to enter the gas valve set 40 and the gas passageway 410 thereof.

Figure 6:
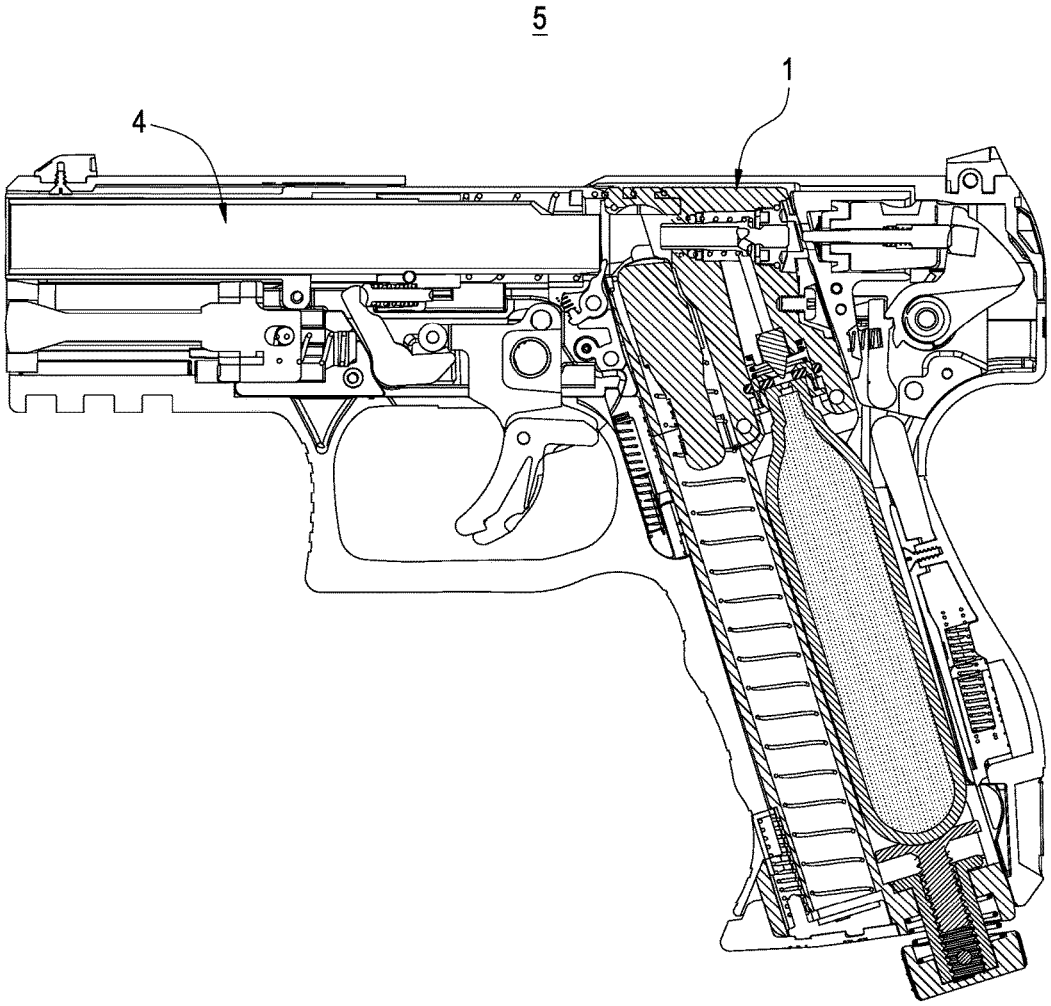
FIG. 6 is a schematic view showing a toy gun according to the present invention.

What shall be addressed is that after the gas inside the gas bottle 2 enters the gas valve set 40 and the gas passageway 410 thereof, the pad moveable seat 43 and the gas bottle nozzle pad 44 are pushed by the gas for being moved towards the direction of the gas bottle 2, and elastically pressed on the gas bottle 2 via the spring 42, so that the airtight effect between the gas bottle 2 and the pad moveable seat 43 can be remained. Accordingly, the gas inside the gas bottle 2 is able to enter the gas passageway 410 for pushing a bullet to be struck so as to provide a power required by the striking operation. Please refer to FIG. 6, which is schematic view showing a toy gun according to the present invention. As shown in FIG. 6, the present invention further provides a toy gun 5 comprising a gun body 4 and the above-mentioned gas bottle installing structure 1. The gas bottle installing structure 1 is combined with the gun body 4 for assembling the toy gun 5.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A gas bottle installing structure (1) for use in toy gun and allowing a gas bottle (2) to be installed therein, comprising:

a gas bottle cylinder (10), including a shell body (11), an accommodation space (100) capable of accommodating the gas bottle (2), and a base (12) disposed at one side of the accommodation space (100) and integrally formed with the shell body (11), wherein the base (12) is formed with a penetration hole (120), and the shell body (11) is formed with a communication hole (110) at an opposite side relative to the penetration hole (120);

a piercing pin seat (20), disposed at one side of the communication hole (110); and a screw seat set (30), including a non-rotatable nut seat (31) penetrating the penetration hole (120), a screw seat (32) combined at an outer end of the nut seat (31), and an elastic member (33) elastically clamped between the base (12) and the screw seat (32).

2. The gas bottle installing structure (1) for use in toy gun according to claim 1, further comprising a gas valve set (40) disposed at one side of the communication hole (110), the gas valve set (40) includes a gas valve seat (41) fastened on the gas bottle cylinder (10) and a spring (42) disposed in the gas valve seat (41), the gas valve seat (41) is formed with a gas passageway (410) communicated with the accommodation space (100), and the piercing pin seat (20) is disposed in the gas passageway (410) and formed with a tip end (21) penetrating the spring (42).

3. The gas bottle installing structure (1) for use in toy gun according to claim 2, wherein the gas valve set (40) further includes a pad moveable seat (43) located in the communication hole (110), and the spring (42) is disposed on the pad moveable seat (43).

4. The gas bottle installing structure (1) for use in toy gun according to claim 3, wherein the gas valve set (40) further includes a gas bottle nozzle pad (44), a groove (431) is formed on an inner wall surface of the pad moveable seat (43), and the gas bottle nozzle pad (44) is fastened in the groove (431).

5. The gas bottle installing structure (1) for use in toy gun according to claim 3, wherein the gas valve set (40) further includes a moveable seat O-ring (45), and the moveable seat O-ring (45) is disposed between the gas valve seat (41) and the pad moveable seat (43).

6. The gas bottle installing structure (1) for use in toy gun according to claim 1, wherein the shell body (11) is extended with an opening (111) at a direction parallel to the gas bottle (2), and the gas bottle (2) is obliquely introduced for being accommodated in the accommodation space (100).

7. The gas bottle installing structure (1) for use in toy gun according to claim 1, wherein the base (12) is formed with a first recess (121) on a lateral surface which faces the screw seat (32), and one end of the elastic member (33) is positioned in the first recess (121).

8. The gas bottle installing structure (1) for use in toy gun according to claim 7, wherein the screw seat (32) is formed with a second recess (320) on a lateral surface which faces the base (12), and the other end of the elastic member (33) is positioned in the second recess (320).

9. The gas bottle installing structure (1) for use in toy gun according to claim 1, wherein the screw seat set (30) further includes a gas bottle propelling screw (34), and the gas bottle propelling screw (34) is screwed in the nut seat (31).

10. The gas bottle installing structure (1) for use in toy gun according to claim 1, wherein the elastic member (33) is a compression spring.

11. A toy gun (5), comprising:

a gun body (4); and a gas bottle installing structure (1), combined with the gun body (4) and allowing a gas bottle (2) to be installed therein, and including:

a gas bottle cylinder (1), including a shell body (11), an accommodation space (100) capable of accommodating the gas bottle (2), and a base (12) disposed at one side of the accommodation space (100) and integrally formed with the shell body (11), wherein the base (12) is formed with a penetration hole (120), and the shell body (11) is formed with a communication hole (110) at an opposite side relative to the penetration hole (120);

a piercing pin seat (20), disposed at one side of the communication hole (110); and a screw seat set (30), including a non-rotatable nut seat (31) penetrating the penetration hole (120), a screw seat (32) combined at an outer end of the nut seat (31), and an elastic member (33) elastically clamped between the base (12) and the screw seat (32).

12. The toy gun (5) according to claim 11, wherein further comprising a gas valve set (40) disposed at one side of the communication hole (110), the gas valve set (40) includes a gas valve seat (41) fastened on the gas bottle cylinder (10) and a spring (42) disposed in the gas valve seat (41), the gas valve seat (41) is formed with a gas passageway (410) communicated with the accommodation space (100), and the piercing pin seat (20) is disposed in the gas passageway (410) and formed with a tip end (21) penetrating the spring (42).

13. The toy gun (5) according to claim 12, wherein the gas valve set (40) further includes a pad moveable seat (43) located in the communication hole (110), and the spring (42) is disposed on the pad moveable seat (43).

14. The toy gun (5) according to claim 13, wherein the gas valve set (40) further includes a gas bottle nozzle pad (44), a groove (431) is formed on an inner wall surface of the pad moveable seat (43), and the gas bottle nozzle pad (44) is fastened in the groove (431).

15. The toy gun (5) according to claim 14, wherein the gas valve set (40) further includes a moveable seat O-ring (45), and the moveable seat O-ring (45) is disposed between the gas valve seat (41) and the pad moveable seat (43).

16. The toy gun (5) according to claim 11, wherein the base (12) is formed with a first recess (121) on a lateral surface which faces the screw seat (32), and one end of the elastic member (33) is positioned in the first recess (121).

17. The toy gun (5) according to claim 16, wherein the screw seat (32) is formed with a second recess (320) on a lateral surface which faces the base (12), and the other end of the elastic member (33) is positioned in the second recess (320).

18. The toy gun (5) according to claim 11, wherein the screw seat set (30) further includes a gas bottle propelling screw (34), and the gas bottle propelling screw (34) is screwed in the nut seat (31).

* * * * *